US011291241B2

(12) United States Patent
Uhthurry

(10) Patent No.: US 11,291,241 B2
(45) Date of Patent: Apr. 5, 2022

(54) SMOKING ARTICLE COMPRISING A FILTER WITH ENHANCED FLAVOURANT RELEASE

(71) Applicant: PHILIP MORRIS PRODUCTS S.A., Neuchatel (CH)

(72) Inventor: Jerome Uhthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 549 days.

(21) Appl. No.: 15/778,283

(22) PCT Filed: Nov. 29, 2016

(86) PCT No.: PCT/EP2016/079160
§ 371 (c)(1),
(2) Date: May 23, 2018

(87) PCT Pub. No.: WO2017/093267
PCT Pub. Date: Jun. 8, 2017

(65) Prior Publication Data

US 2018/0338523 A1 Nov. 29, 2018

(30) Foreign Application Priority Data

Nov. 30, 2015 (EP) ..... 15197103

(51) Int. Cl.
*A24D 3/02* (2006.01)
*A24D 3/04* (2006.01)

(52) U.S. Cl.
CPC ..... *A24D 3/0216* (2013.01); *A24D 3/043* (2013.01); *A24D 3/048* (2013.01)

(58) Field of Classification Search
CPC ..... A24D 3/0216; A24D 3/043; A24D 3/061
See application file for complete search history.

(56) References Cited

U.S. PATENT DOCUMENTS 7,987,857 B2 8/2011 Gawad
9,066,541 B2 6/2015 Allen
(Continued)

FOREIGN PATENT DOCUMENTS

CN 102266121 12/2011
CN 103917115 7/2014
(Continued)

OTHER PUBLICATIONS

PCT Search Report and Written Opinion for PCT/EP2016/079160 dated Mar. 2, 2017 (11 pages).
(Continued)

*Primary Examiner* — Michael H. Wilson
*Assistant Examiner* — Jennifer A Kessie
(74) *Attorney, Agent, or Firm* — Mueting Raasch Group

(57) ABSTRACT

There is provided a smoking article (10) comprising a tobacco rod (12) and a filter (14) axially aligned in an abutting end-to-end relationship. The filter (14) consists of a single segment of filtration material having an overall length (L) and extending from a mouth end (16) to a tobacco rod end (18). The smoking article (10) comprises a ventilation zone (20) at a location at a first distance (V) from the mouth end (16) of the filter; and an additive delivery element (22) upstream of the ventilation zone (20) and at a second distance (C) from the mouth end (16) of the filter (14). The ventilation zone (20) is at least 5 mm apart from the additive delivery element (22). The overall length (L) of the filter is from 20 mm to 30 mm; the first distance (V) is from 11 mm to 22 mm; and the second distance (C) is from 16 mm to 27 mm.

5 Claims, 3 Drawing Sheets

(56) References Cited

U.S. PATENT DOCUMENTS

| | | | | |
|---|---|---|---|---|
| 10,004,256 | B2 | 6/2018 | Jordil | |
| 10,433,578 | B2 | 10/2019 | Jordil | |
| 2011/0120481 | A1* | 5/2011 | Besso | A24D 3/061<br>131/275 |

FOREIGN PATENT DOCUMENTS

| | | |
|---|---|---|
| CN | 105050435 | 11/2015 |
| EP | 2308329 | 4/2011 |
| EP | 2856891 | 4/2015 |
| EP | 2896304 | 7/2015 |
| JP | 2013-523114 | 6/2013 |
| WO | WO 2013/179524 | 12/2013 |
| WO | WO 2014/154887 | 10/2014 |
| WO | WO 2015/107975 | 7/2015 |

OTHER PUBLICATIONS

Office Action issued in China for Application No. 201680067833.7 dated Apr. 27, 2020 (15 pages). English translation included.
Office Action issued in Japan for Application No. 2018-526749 dated Jan. 4, 2021 (9 pages). English translation included.

* cited by examiner

SMOKING ARTICLE COMPRISING A FILTER WITH ENHANCED FLAVOURANT RELEASE

This application is a U.S. National Stage Application of International Application No. PCT/EP2016/079160, filed Nov. 29, 2016, which was published in English on Jun. 8, 2017, as International Publication No. WO 2017/093267 A1. International Application No. PCT/EP2016/079160 claims priority to European Application No. 15197103.3 filed Nov. 30, 2015.

The present invention relates to a smoking article comprising a filter, such as a filter cigarette. Further, the present invention relates to a method for manufacturing one such smoking article and filter.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper.

It is known to provide one such smoking article comprising a filter with ventilation perforations at a location along the filter. Ventilation dilutes all of the material flowing through the smoking article, and so reduces both the particulate phase and the gas phase constituents of the mainstream smoke.

Smoking articles including one or more additives that are released into the mainstream smoke of the smoking article during combustion, in order to modify the smoking characteristics thereof, are also known in the art. For example, flavourants may be used to enhance the tobacco flavours produced upon heating or combusting the tobacco material, or to provide additional non-tobacco flavours such as mint or menthol. The additives may be provided in a liquid delivery element, such as a capsule, comprising structural material enclosing the additive. The encapsulated additive may be released prior to or during smoking of the smoking article by deforming or destroying the encapsulating structure, for example by crushing.

In smoking articles including a flavourant delivery element, the ventilation zone is generally provided upstream of the flavourant delivery element. This is generally considered to be advantageous in that the flavourant released into the mainstream smoke is not diluted by the air drawn into the filter at a downstream location. Further, by one such arrangement, the likelihood that the liquid flavourant may leak out of the perforations defining the ventilation zones is limited.

In general, it would be desirable to provide a smoking article by which an enhanced transfer of additive into the mainstream smoke may be obtained. Further, it would be desirable to provide one such improved smoking article wherein, at the same time, the tar delivery is maintained within an acceptable range.

Finally, it would be desirable to provide one such smoking article that is cost-effective and easy to manufacture in that it does not require any major modification of the existing apparatus, and a method for the manufacture thereof.

According to an aspect of the present invention, there is therefore provided a smoking article comprising a tobacco rod; and a filter axially aligned in an abutting end-to-end relationship with the tobacco rod, the filter being formed from a single segment of filtration material having an overall length (L) and extending from a mouth end to a tobacco rod end. The smoking article further comprises a ventilation zone at a location along the filter segment at a first distance (V) from the mouth end of the filter; and an additive delivery element at a location along the filter segment upstream of the ventilation zone and at a second distance (C) from the mouth end of the filter, such that the ventilation zone is at least about 5 millimetres apart from the additive delivery element. The overall length (L) of the filter is from about 20 millimetres to about 36 millimetres. The first distance (V) between the ventilation zone and the mouth end of the filter is from about 11 millimetres to about 28 millimetres. Further, the second distance (C) between the additive delivery element and the mouth end of the filter is from about 16 millimetres to about 33 millimetres.

According to a further aspect of the present invention, there is provided a method of manufacturing a smoking article, the method comprising the steps of: providing a continuous rod of filtration material; embedding additive delivery elements in the filtration material such that consecutive additive delivery elements are spaced apart in the longitudinal direction of the rod alternatively by a first distance (D1) and a second distance (D2), wherein the first distance is from about 22 millimetres to about 56 millimetres and the second distance is from about 6 millimetres to about 16 millimetres; cutting the continuous filter rod at cut lines spaced longitudinally by a third distance (D3), wherein the third distance (D3) is from about 20 millimetres to about 36 millimetres, to produce filter segments of filtration material, each filter segment including an additive delivery element embedded in the filter segment; attaching a filter segment to a tobacco rod in an abutting end-to-end relationship by means of a tipping material, such that the additive delivery element is closer to a tobacco rod end of the filter segment than to a mouth end of the filter segment; and providing a ventilation zone comprising perforations through the tipping material at a location downstream of the additive delivery element, such that the additive delivery element is at least about 5 millimetres apart from the ventilation zone.

According to another aspect of the present invention, there is provided a filter for a smoking article, the filter being formed of a single segment of filtration material having an overall length (L) and extending from a first end to a second end. The filter comprises a ventilation zone at a location along the filter segment between the first end and the second end; and an additive delivery element at a location along the filter segment between the ventilation zone and the second end, such that the additive delivery element is at least about 5 millimetres apart from the ventilation zone. The overall length (L) of the filter is from about 20 millimetres to about 36 millimetres; a first distance between the ventilation zone and the first end of the filter is from about 11 millimetres to about 28 millimetres; and a second distance (C) between the additive delivery element and the first end of the filter is from about 16 millimetres to about 33 millimetres.

According to one further aspect of the present invention, there is provided a method of manufacturing filters for smoking article, the method comprising the steps of: providing a continuous rod of filtration material; embedding additive delivery elements in the filtration material such that consecutive additive delivery elements are spaced apart in the longitudinal direction of the rod alternatively by a first distance (D1) and a second distance (D2), wherein the first distance is from about 22 millimetres to about 56 millimetres and the second distance is from about 6 mm to about 16 mm; cutting the continuous filter rod at cut lines spaced longitudinally by a third distance (D3), wherein the third distance (D3) is from about 20 millimetres to about 36 millimetres, to produce filter segments of filtration material, each filter segment including an additive delivery element embedded in the filter segment.

It shall be appreciated that any features described with reference to one aspect of the present invention are equally applicable to any other aspect of the invention.

The present invention provides a smoking article of the type comprising a tobacco rod and a filter attached to the tobacco rod. The filter is formed of a single segment of filtration material that extends all the way from a mouth end of the smoking article to the tobacco rod. A ventilation zone is provided at a location along the filter segment, at a first distance (V) from the mouth end of the filter and of the smoking article. In contrast to existing smoking articles, according to the present invention an additive delivery element is arranged at a location along the filter segment upstream of the ventilation zone, at a second distance (C) from the mouth end of the filter such that the ventilation zone is at least about 5 millimetres apart from the additive delivery element. The overall length (L) of the filter is from about 20 millimetres to about 36 millimetres. The first distance (V) between the ventilation zone and the mouth end of the filter is from about 11 millimetres to about 28 millimetres. The second distance (C) between the additive delivery element and the mouth end of the filter is from about 16 millimetres to about 33 millimetres.

In practice, in smoking articles and filters according to the present invention, an additive delivery element is provided at a location along the longitudinal axis of the filter that is asymmetric, that is, is closer to one end of the filter than to the other. In particular, the additive delivery element is closer to the tobacco rod end than to the mouth end of the filter, and a ventilation zone is provided at a location along the filter downstream of the additive delivery element.

Without wishing to be bound to theory, it is understood that, because the additive delivery element is arranged closer to the tobacco rod end of the filter than in known filters, the heat developed by the combustion of tobacco advantageously enhances the transfer of the additive into the mainstream smoke. This is particularly effective when the additive is a liquid flavourant, such as menthol.

Accordingly, it is easy to provide smoking articles with an enhanced additive release, which may not only be measured but also perceived, for example as a more intense burst of flavour, by a consumer. Further, because smoking articles and filters according to the present invention are ventilated, the increase in the transfer of additive into the mainstream smoke is advantageously paired with a controlled tar delivery.

It is easy to achieve this enhanced additive release effect with a single-segment filter. This is advantageous, in that there is no need to manufacture two or more separate filter segments to subsequently combine them, and so the manufacturing process does not involve a very high number of operations and does not require a precise and coordinated handling of different filter components, as is the case with multi-segment filters known in the art, wherein several segments need to be brought into alignment and may need to be arranged at a predetermined distance from one another, for example for forming an internal cavity. Thus, only minor modifications of existing apparatus are required to implement the manufacturing methods in accordance with the invention.

As used herein, the expression "formed from a single segment" is used to describe a filter that includes only one segment of filtration material extending all the way from the downstream end of the smoking article to the tobacco rod. In other words, the filter does not include any other segment of filtration material or cavity or tubular element.

The term "overall length of the filter" is used throughout the specification to refer to the length of the only filtration segment forming the filter and is construed as the distance between the downstream, or mouth end, of the smoking article and the upstream end of the filter, which abuts the tobacco rod. All distances and lengths are measured with reference to a longitudinal axis of the smoking article and filter.

In its most general terms, a smoking article according to the present invention comprises a tobacco rod and a filter axially aligned in an abutting end-to-end relationship with the tobacco rod, wherein the filter is formed of a single segment of filtration material having an overall length (L) and extending from a mouth end to a tobacco rod end.

The segment of filtration material is preferably provided as a plug of fibrous filtration material, such as cellulose acetate tow. A filter plasticiser may be applied to the fibrous filtration material in a conventional manner, by spraying it onto the separated fibres, preferably before applying any additional material to the filtration material. The segment of filtration material is typically circumscribed by a filter wrapper (or plug wrap). Preferably, the filter wrapper circumscribes the full length of the segment of filtration material. Examples of suitable filter wrapper materials include, but are not limited to, cellulose based materials, paper, cardboard, recon, cellulose based film, and combinations thereof.

The smoking article further comprises a ventilation zone at a location along the filter segment at a first distance (V) from the mouth end of the filter.

The ventilation zone preferably comprises at least one circumferential row of perforations formed through the filter wrapper. In some embodiments, the ventilation zone may for example comprise two circumferential rows of perforations. The perforations may be formed online during manufacture of the smoking article. Preferably, each circumferential row of perforations comprises from 8 to 30 perforations.

Further, the smoking article comprises an additive delivery element at a location along the filter segment upstream of the ventilation zone and at a second distance (C) from the mouth end of the filter, such that the ventilation zone is at least about 5 mm apart from the additive delivery element.

The additive delivery element may comprise a capsule or microcapsule comprising a frangible outer shell and an inner core containing the additive. The encapsulated additive can be released prior to or during smoking of the smoking article by breaking open the encapsulating structure, for example by crushing or melting the structure. Where one such capsule is crushed to release the additive, the capsule breaks open at a particular force and releases substantially all of the flavourant at that force ("single-burst release"). Accordingly, the concentration of additive in the mainstream smoke increases very rapidly to reach a peak value, only to progressively diminish with time during smoking of the smoking article.

As an alternative, the additive may be encapsulated within a matrix material, and compression is applied to the matrix material in order to release the additive.

The additive encapsulated within a matrix material may be released more gradually than with a capsule. Unlike with the encapsulating structure of a capsule, the matrix structure does not break open to release all of the additive at a particular force but is gradually broken down as the force is sustained. Thus, where the additive is encapsulated within a matrix material, a sustained or progressive release is achieved. Those of skill in the art will understand that the term "sustained release" covers those embodiments in which the amount of additive released at a given force depends additionally on the duration of the applied force. For example, in some embodiments, two brief applications of a given force may release the same amount of additive composition as a single, extended application of the given force. In these embodiments, it is possible to use the sustained release properties of the material to provide multiple "doses" of the additive-containing composition by repeatedly applying the same or similar force to the additive delivery material. In addition, multiple applications of progressively higher forces can also be used, which in some cases can increase the amount of additive in the multiple "doses" that are released.

With smoking article according to the present invention, because the transfer of additive into the mainstream smoke is made more effective, it is thus possible to present the consumer with novel additive release dynamics and, in embodiments where the additive is a flavourant, more intense flavour notes over a prolonged time.

The overall length (L) of the filter is from about 20 millimetres to about 36 millimetres. The first distance (V) between the ventilation zone and the mouth end of the filter is from about 11 millimetres to about 28 millimetres. Further, the second distance (C) between the additive delivery element and the mouth end of the filter is from about 16 millimetres to about 33 millimetres.

The inventors have identified the overall length (L), the first distance (V) between the ventilation zone and the mouth end of the filter, and the second distance (C) between the additive delivery element and the mouth end of the filter as critical dimensions which, in combination, positively impact the additive transfer into the mainstream smoke, whilst at the same time leading to satisfactory RTD and tar delivery values.

Without wishing to be bound to theory, it is thought that, because the additive delivery element is arranged asymmetrically at a location along the filter closer to the tobacco rod end than to the mouth end, exposure of the additive delivery element to heat generated by combustion of the tobacco rod during smoking is enhanced. Higher temperatures favour transfer of the additive into the mainstream smoke, especially in the case of volatile additives, such as many flavourants are.

Preferably, a third distance (E) between the additive delivery element and the tobacco rod end of the filter is at least about 3 millimetres. This accounts for manufacturing tolerances, and advantageously ensures that filters produced in accordance with the present invention consistently include an additive delivery element at the desired location, such that the number of filters that need to be rejected because they do not meet the product specification is limited.

Preferably, the third distance (E) between the additive delivery element and the tobacco rod end of the filter is less than about 10 millimetres.

As shall be described in more detail below (see Examples 1 and 2), the inventors have found that an additive delivery element arranged at a location along the filter from about 10 millimetres to about 3 millimetres from the tobacco rod end of the filter is advantageously exposed to steeper temperature gradients during smoking of the smoking article. Further, the inventors have observed that an additive delivery element arranged within the filter region extending from about 10 millimetres to about 3 millimetres from the tobacco rod end reaches higher temperatures after a smaller number of puffs, compared to additive delivery elements at more downstream locations.

Without wishing to be bound to theory, this is understood to accelerate and facilitate evaporation of a volatile liquid additive released from the delivery element, such that the additive becomes effectively available for transfer into the mainstream smoke earlier and at a greater rate. This is the case, in particular, where the additive delivery element is provided as a frangible capsule containing the additive and the capsule is crushed prior to lighting the smoking article. Further, it is particularly advantageous in those embodiments where the additive is a flavourant. If the consumer releases the flavourant by applying a force on the delivery element prior to the first puff, a greater amount of flavouring species will reach the consumer's mouth after a noticeably smaller number of puffs, compared with known smoking articles. Thus, the consumer is advantageously presented with a different sensory experience.

Preferably, the distance between the ventilation zone and the additive delivery element is as great as possible. In other words the difference between the second distance (C) and the first distance (V) is preferably maximised.

Without wishing to be bound to theory, it is understood that, once the additive is released from the delivery element into the mainstream smoke, the flow of mainstream smoke transports the additive along the filter and towards the consumer's mouth. Whilst being transported towards the mouth end of the filter, the additive generally also diffuses across the cross section of the filter.

In conventional smoking articles, wherein the ventilation zone is provided upstream of the additive delivery element, the mainstream smoke is diluted with the air drawn into the filter through the openings of the ventilation zone as it advances along the filter towards the additive delivery element. Thus, it is a flow of already diluted mainstream smoke that reaches the additive delivery element and as such gets mixed with the additive, prior to reaching the consumer's mouth. By contrast, in smoking articles in accordance with the present invention, a flow of undiluted mainstream smoke reaches the additive delivery element and is mixed with the additive released from the delivery element before the resulting mixture reaches the ventilation zone. Because the ventilation zone is downstream of the additive delivery element and closer to the mouth end of the filter, such mixture has little time and a short filter length to travel along before reaching the consumer's mouth. Thus, in smoking article according to the present invention, the relative concentration of additive and mainstream smoke in the mixture effectively reaching the consumer's mouth is noticeably different from what is common in conventional smoking articles.

Further, in conventional smoking articles, because the mainstream smoke is diluted with cooler ambient air prior to reaching the delivery element, the temperature of the gaseous mixture contacting the additive released from the delivery element is noticeably lower than the temperature of the undiluted mainstream smoke reaching the delivery element in smoking articles in accordance with the present invention.

The wider the distance between the ventilation zone and the additive delivery element, the longer the residence time during which the additive diffuses radially without any external perturbation. Accordingly, by maximising the difference between the second distance (C) and the first distance (V), a more homogeneous distribution of the additive is favoured. This condition is particularly desirable where the additive is a flavourant, because a flatter concentration profile is more likely to provide the consumer a richer and more rounded flavour note, despite the partial diluting effect brought about by the mixing with ventilation air downstream of the location of the ventilation zone.

Preferably, the difference between the second distance (C) and the first distance (V) is at least about 18 millimetres. Even more preferably, the difference between the second distance (C) and the first distance (V) is at least about 20 millimetres.

The ratio between the difference between the second distance (C) and the first distance (V) and the overall length (L) of the filter can be taken as an indicator of what proportion of the filter volume is available for the additive released into the mainstream smoke to diffuse before mixing with the flow of ventilation air. Thus, in view of the explanation given above, the (C−V)/L ratio can also be regarded as an indicator of how homogenously the additive is distributed over the cross-section of the filter when the flow of mainstream smoke reaches the consumer's mouth.

Preferably, the (C−V)/L ratio is at least about 0.45. More preferably, the (C−V)/L ratio is at least about 0.55. Even more preferably, the (C−V)/L ratio is at least about 0.6.

In some preferred embodiments, the overall length (L) of the filter is less than about 30 millimetres, the first distance (V) between the ventilation zone and the mouth end of the filter is less than about 22 millimetres, and the second distance (C) between the additive delivery element and the mouth end of the filter is less than about 27 millimetres. Even more preferably, the overall length (L) of the filter is at least about 25 millimetres. The inventors have found that smoking articles having such combinations of critical dimensions combine a desirably improved additive transfer with particularly satisfactory values of resistance to draw (RTD).

Preferably, the additive delivery element is a breakable capsule containing a liquid flavourant. Thus, smoking articles that present the consumer with a novel sensory experience associated with enhanced flavour notes.

Suitable flavours to be provided by the liquid flavourant include, but are not limited to, natural or synthetic menthol, peppermint, spearmint, coffee, tea, spices (such as clove), eucalyptus, eugenol and linalool. In preferred embodiments, the flavourant comprises menthol.

Preferably, the liquid flavourant includes an essential oil, or a mixture of one or more essential oils. An "essential oil" is a volatile oil having the characteristic odour and flavour of the plant from which it is obtained. Suitable essential oils for inclusion in the additive delivery element of smoking articles according to the present invention include, but are not limited to, peppermint oil and spearmint oil. The one or more essential oils may be provided in a solution of, for example, ethanol.

Smoking articles according to the present invention may be manufactured by a method wherein additive delivery elements are embedded in a continuous rod of filtration material, such that consecutive additive delivery elements are spaced apart in the longitudinal direction of the rod alternatively by a first distance (D1) and a second distance (D2), wherein the first distance is from about 22 millimetres to about 56 millimetres and the second distance is from about 6 millimetres to about 16 millimetres. Preferably, the additive delivery elements are surrounded on all sides by the filtration material.

Typically, the continuous rod of filtration material and additive delivery elements are wrapped with a continuous sheet of plug wrap to form a wrapped continuous filter rod. The thus obtained continuous filter rod is then cut at cut lines spaced longitudinally by a third distance (D3), wherein the third distance (D3) is from about 20 millimetres to about 36 millimetres, to produce filter segments of filtration material, each filter segment including an additive delivery element embedded in the filter segment.

Preferably, in the step of cutting the continuous filter rod, the cut lines are spaced such that in each filter segment the additive delivery element is at a distance of 0.5 times the second distance (D2) from one end of the filter segment and at 0.5 times the first distance (D1) from the opposite end of the filter segment. One such filter segment is attached to a tobacco rod in an abutting end-to-end relationship by means of a tipping material, such that the additive delivery element is closer to a tobacco rod end of the filter segment than to a mouth end of the filter segment.

A ventilation zone comprising perforations through the tipping material and the plug wrap is formed at a location downstream of the additive delivery element, such that the distance between the additive delivery element and the ventilation zone is at least 5 mm.

The ventilation zone may be formed after attaching the filter to the tobacco rod. As an alternative, the ventilation zone may be formed in line during the manufacture of the filter prior to attaching the filter to the tobacco rod.

Filters for smoking article in accordance with the present invention may be prepared by methods wherein additive delivery elements are embedded in a continuous rod of filtration material, such that consecutive additive delivery elements are spaced apart in the longitudinal direction of the rod alternatively by a first distance (D1) and a second distance (D2), wherein the first distance is from about 22 millimetres to about 56 millimetres and the second distance is from about 6 millimetres to about 16 millimetres. Preferably, the additive delivery elements are surrounded on all sides by the filtration material.

Typically, the continuous rod of filtration material and additive delivery elements are wrapped with a continuous sheet of plug wrap to form a wrapped continuous filter rod.

The thus obtained continuous filter rod is then cut at cut lines spaced longitudinally by a third distance (D3), wherein the third distance (D3) is from about 20 millimetres to about 36 millimetres, to produce filter segments of filtration material, each filter segment including an additive delivery element embedded in the filter segment.

This is contrast with the known methods for forming filters for smoking articles containing a non-cuttable object, such as an additive delivery element, or a restrictor, wherein the non-cuttable objects are equally spaced along the longitudinal axis of the continuous rod of filtration material. Further, in such known methods, the continuous filter rod is cut at locations equally spaced along the longitudinal axis of the continuous rod of filtration material, such that each resulting filter segment includes an additive delivery element embedded at a substantially centred location in the filter segment.

In methods according to the present invention, the ventilation zone is preferably formed between consecutive additive delivery elements spaced apart by the first distance (D1) and such that the distance between the additive delivery element and the ventilation zone is at least 5 mm, the ventilation zone.

The invention will be further described, by way of example only, with reference to the drawings of the accompanying Figures, wherein.

Figure 1:
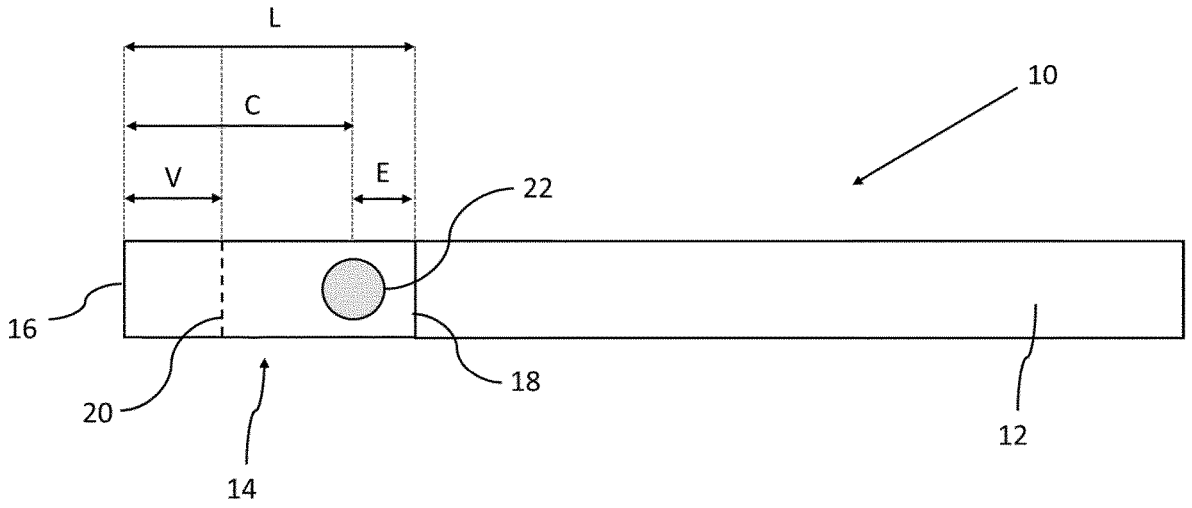
FIG. 1 illustrates a schematic sectional view of a smoking article in accordance with the present invention.

FIG. 1 shows a smoking article 10 comprising a tobacco rod 12 and a filter 14. The filter 14 is axially aligned in an abutting end-to-end relationship with the tobacco rod 12, and is formed of a single segment of filtration material extending from a mouth end 16 to a tobacco rod end 18. The overall length L of the filter 12 is of about 27 millimetres.

The smoking article 10 comprises a ventilation zone 20 comprising a plurality of holes disposed about the circumference of the filter. The ventilation zone 20 is at a location along the filter 12 at a distance V of about 12 millimetres from the mouth end 16. Further, the smoking article 10 comprises an additive delivery element 22 at a location along the filter segment upstream of the ventilation zone 20 and at a second distance C of about 18 millimetres from the mouth end 16. Thus, the ventilation zone 20 is about 6 millimetres apart from the additive delivery element 22. Further, the additive delivery element 22 is at a third distance E of about 9 mm from the tobacco rod end 18. The additive delivery element 22 is provided as a frangible capsule having a diameter of about 4.2 millimetres and containing menthol.

Temperature Profile Assessment

Variations in the temperature profile within the filter of a smoking article during smoking have been assessed under the Health Canada Intense (HCl) smoking regime. To this purpose, measurements have been carried out on a reference smoking article 20 (8 mg tar (ISO)) comprising a tobacco rod 22 of about 57 millimetres and a single-segment filter 24 of about 27 millimetres has been used, the tobacco rod and the filter having a diameter of about 7.9 millimetres. In the reference smoking article, the tobacco rod is circumscribed by a wrapper having a permeability of about 45 Coresta units. The filter is attached to the tobacco rod by a band of tipping having a permeability of 298 Coresta Units.

Figure 2:
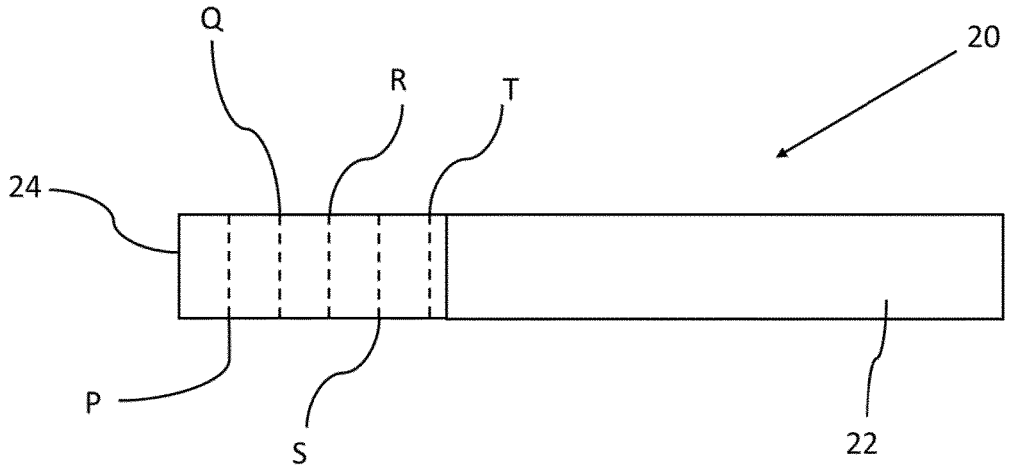
FIG. 2 is a schematic side view of a filter of a reference smoking article showing locations along the filter where temperature has been measured during smoking (Example 1)

As shown schematically in FIG. 2, thermocouples have been set to measure the temperature at different locations along the filter, namely at points:

P: 5 millimetres from the mouth end;

Q: 10 millimetres from the mouth end;

R: 15 millimetres from the mouth end;

S: 20 millimetres from the mouth end; and

T: 25 millimetres from the mouth end.

The reference smoking article has been smoked under the HCl regime, which entails the following parameters:

Ventilation: 100 percent blocked;

Puff frequency: 30 seconds;

Puff duration: 2 seconds;

Puff volume: 55 cubic centimetres.

Figure 3:
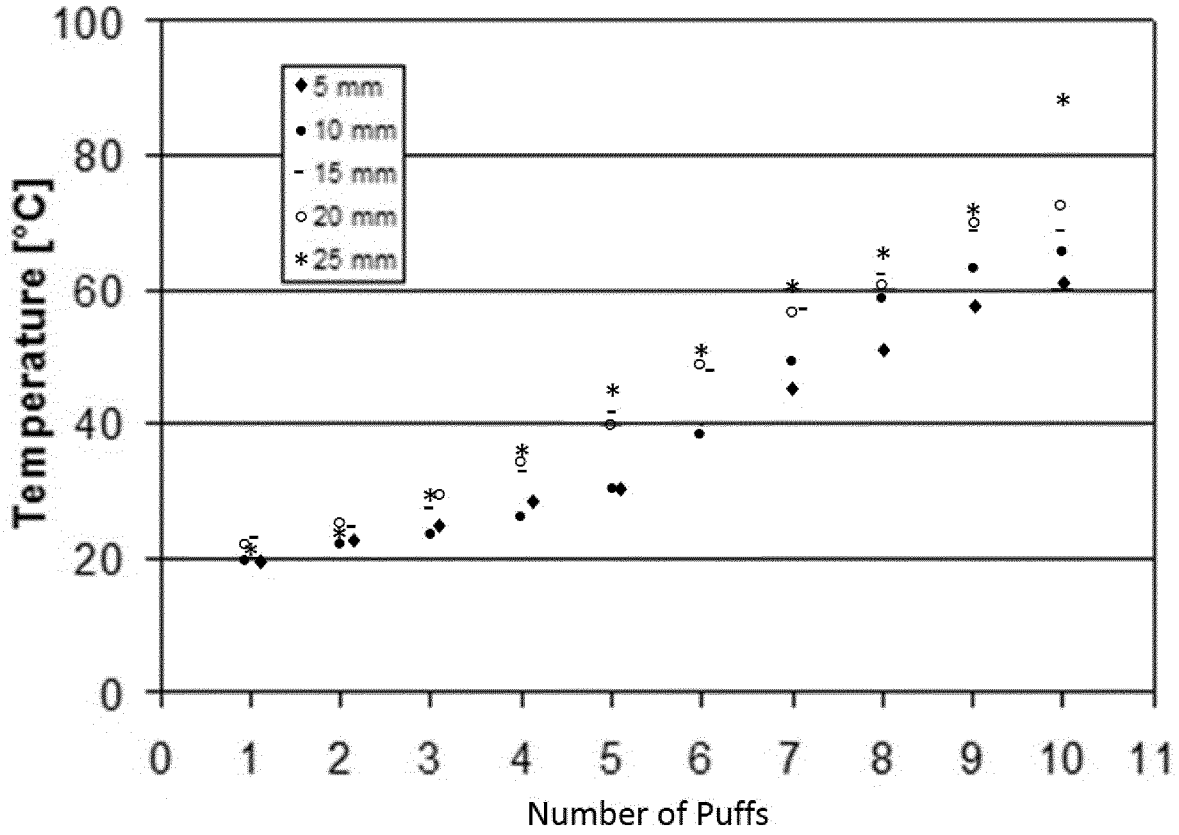
FIG. 3 is a chart showing how temperature varies during smoking of the reference smoking article at the locations of FIG. 2.

The graph of FIG. 3 illustrates how temperature varies over time during smoking, that is, with the number of puffs. Different curves have been plotted for the locations P-T along the filter. Unsurprisingly, temperature generally increases at all locations with every additional puff, as the length of the tobacco rod decreases and the combustion front becomes progressively nearer to the tobacco rod/filter interface. However, it has been surprisingly found that, from the third puff onward, temperature increases much faster and reaches significantly higher values at locations R to T, that is from about 15 millimetres to about 25 millimetres from the mouth end, compared with locations P and Q. In addition, from the sixth puff onward, a further significant distinction in the temperature profile becomes apparent between locations S-T, that is from about 20 millimetres to about 25 millimetres from the mouth end, and the other downstream locations.

The highest temperature is consistently reached at location T. While at locations P-R temperature appears to approximate a plateau around the ninth or tenth puff, a monotonically increasing trend is observed past at locations S and T.

Thus, locations at least about 20 millimetres from the mouth end—that is, at 7 millimetres or less from the tobacco rod end—not only reach generally higher temperatures compared with more downstream locations, but are also exposed to greater temperature gradients, such that higher temperatures are reached sooner than at more downstream locations, and such that temperatures continue to increase substantially during smoking, even when temperature essentially stabilises at more downstream location.

On the other hand, at locations from about 10 millimetres to about 15 millimetres from the mouth end—that is, at positions centred around the midpoint (13.5 millimetres from the mouth end of the filter—temperatures are not only consistently lower during the whole smoking test, but also increase at a progressively lower rate from the sixth/seventh puff onward.

It should be clear that the whole section of the filter of a smoking article in accordance with the invention upstream of the ventilation zone would be essentially identical to the filter of the reference smoking article described above. Accordingly, without wishing to be bound to theory, it can reasonably be assumed that, at least in qualitative terms, a similar trend would be observed during smoking of a smoking article in accordance with the invention. In particular, these experimental results confirm that the transfer of an additive into the mainstream smoke can be thermally enhanced most significantly by arranging the delivery element at locations from 2 millimetres to 12 millimetres from the tobacco rod end.

EXAMPLE 1

A smoking article in accordance with the present invention (see the description of smoking article 10 above) has been subjected to a smoking test and the menthol delivery into the mainstream smoke (MIS) as well as the tar delivery (TAR), along with other characteristics of the mainstream smoke, have been measured.

COMPARATIVE EXAMPLE

The behaviour of the smoking article of Example 1 has been compared with a reference smoking article that is substantially identical to the smoking article 10 and only differs from the smoking article of Example 1 insofar as the additive delivery element is arranged at a centred location along the longitudinal axis of the filter, whilst the ventilation zone is upstream from the additive delivery system. In other words, in the comparative smoking article, L=27 millimetres, V=18 millimetres and C=13.5 millimetres.

Quantitative determination of the menthol content in the mainstream smoke is carried out by GC-FID. The mainstream smoke of cigarettes smoked on a smoking machine is collected on glass fibre filter pads. An alcohol extract of smoke trapped on these filters is analysed.

To this purpose, the smoking article is smoked in accordance with Q0309 "Determination of Total Particulate Matter and Carbon Monoxide (CO) in Mainstream Smoke Using a Non-Automatic Linear Smoking Machine" or equivalent when a 20-channel linear smoking machine (Cerulean) is used and to Q0338 "Determination of Total Particulate Matter and Carbon Monoxide in Mainstream Smoke using an RM-200 or RM20 Smoking Machine" or equivalent when a rotary smoking machine (Borgwaldt) is used. However, in the determination of menthol content, the following exceptions concerning the preparation and conditioning of the cigarette samples apply:

- a sample of at least 80 cigarettes must be subjected to the test;
- on the day of the test, 40 acceptable cigarettes must be selected from the conditioned packs, so as to eliminate obvious nonconformities (such as void ends, torn rods, badly attached filters etc.), and stored in a closed container until they are smoked (the maximum storage time is 12 hours);
- menthol has to be released from the additive delivery element (for example, by crushing, in the case of a frangible capsule) prior to smoking; smoking must start within 5 minutes of release.

Further, reference can be made to ISO 13110 "Cigarettes—Determination of menthol in smoke condensates—Gas chromatographic method".

The content of carbon monoxide may be determined in accordance with the CORESTA Recommended Method No. 5—Determination of Carbon Monoxide in the Mainstream Smoke of Cigarettes by Non-Dispersive Infrared Analysis (second edition, September 1993). The content of nicotine is determined in accordance with the CORESTA Recommended Method No. 7—Determination of Nicotine in the Mainstream Smoke of Cigarettes by Gas Chromatographic Analysis (second edition, August 1991). Ventilation may be determined in accordance with the CORESTA Recommended Method No. 6—Determination of Ventilation: Definitions and Measurement Principles (second edition, March 2000). Resistance To Draw (RTD) may be determined in accordance with the CORESTA Recommended Method No. 41—Determination of the Draw Resistance of Cigarettes and Filter Rods (second edition, June 2007). The content of Total Particulate Matter (TPM) may be determined in accordance with the CORESTA Recommended Method No. 23—Determination of Total Particulate Matter and Preparation for Water and Nicotine Measurements (second edition, August 1991).

The following Table 1 contains data obtained from the smoking test. The bar chart of FIG. 4 visually illustrates the differences between the behaviour of the smoking article 10 according to the present invention and the comparative smoking article in accordance with the prior art.

TABLE 1

| | CO [mg] | Nicotine [mg] | TAR [mg] | TPM [mg] | $H_2O$ [mg] | No. Puffs | MIS [mg] | RTD [$mmH_2O$] | Ventilation [percent] |
|---|---|---|---|---|---|---|---|---|---|
| Example 1 | 6.46 | 0.40 | 6.61 | 7.59 | 0.59 | 7.47 | 1.22 | 84 | 55 |
| Comparative Example | 5.59 | 0.42 | 6.22 | 7.29 | 0.65 | 7.71 | 0.90 | 93 | 60 |

Figure 4:
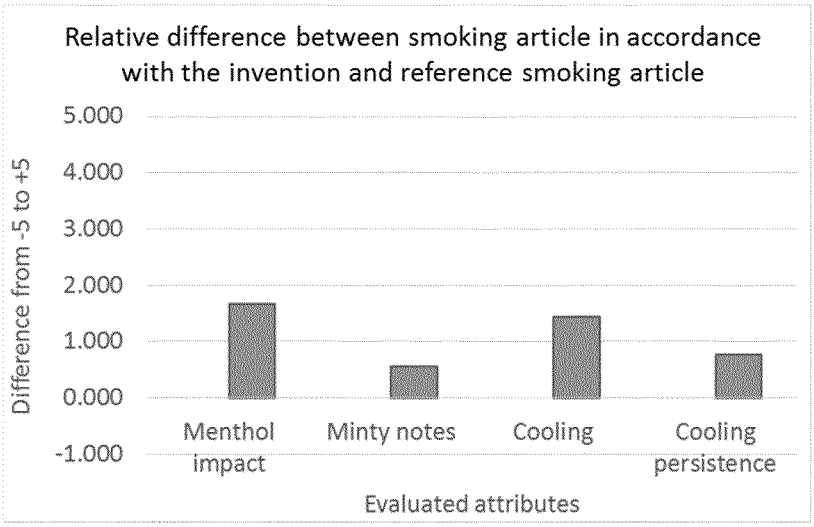
FIG. 4 is a bar chart comparing features of a smoking article in accordance with the present invention with the corresponding features of a reference smoking article in accordance with the prior art.

As can be seen, an increase of about 35 percent in the menthol delivery is obtained with a smoking article in accordance with the present invention with respect to the comparative smoking article. As shown in the chart of FIG. 4, this leads to an enhanced flavour impact which is easily perceived by the consumer, not only in terms of intensity of the minty and cooling notes, but also in terms of persistence of the cooling sensation during smoking of the smoking article. This has been assessed by means of a routine testing test involving a panel of regular smokers.

EXAMPLE 2

An additional set of smoking articles (A, B, C) in accordance with the present inventions was also subjected to the same smoking test. The smoking articles A, B, C of Example 2 differ from the smoking article of Example 1 in that the additive delivery element 22 is provided as a frangible capsule with a diameter of 3.5 millimetres. Further, the smoking articles A, B, C of Example 2 are designed to have different levels of TAR delivery (about 2 milligrams, 7 milligrams and 13 milligrams, respectively). For each smoking article A, B, C in accordance with the present invention, a corresponding reference smoking article with L=27 millimetres, V=18 millimetres and C=13.5 millimetres was also smoked.

The following Table 2 contains data obtained from the smoking test.

TABLE 2

| | CO [mg] | TAR [mg] | No. Puffs | MIS [mg] | Nicotine [mg] | MIS variation [%] |
|---|---|---|---|---|---|---|
| Example 2 (A) | 2.7 | 2.2 | 8.7 | 0.40 | 0.16 | +30 |
| Comparative Example (A) | 2.2 | 2.3 | 8.8 | 0.31 | 0.17 | = = = |
| Example 2 (B) | 7.7 | 7 | 7.7 | 0.91 | 0.49 | +29 |
| Comparative Example (B) | 6.9 | 6.9 | 7.7 | 0.70 | 0.50 | = = = |
| Example 2 (C) | 12.5 | 12.7 | 7.1 | 1.32 | 0.60 | +18 |
| Comparative Example (C) | 12.0 | 13.2 | 6.9 | 1.12 | 0.91 | = = = |

These experimental results confirm that with smoking articles in accordance with the present invention the transfer of menthol into the mainstream smoke is significantly enhanced, regardless of the TAR content. In particular, the increase in the menthol release remains substantially constant at about 30 percent as the TAR content increases from about 2 milligrams to about 7 milligrams.

Figure 5:
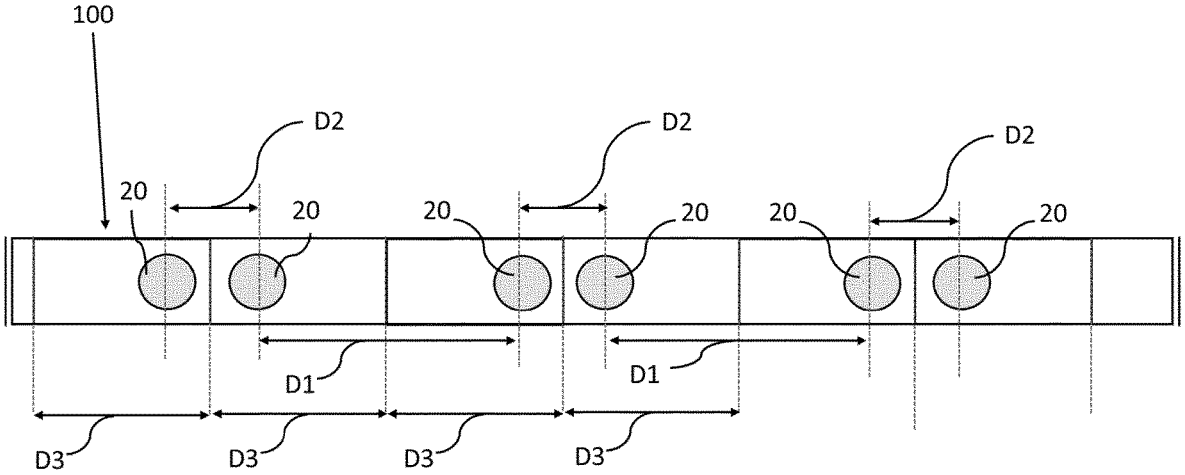
FIG. 5 shows a an exemplary method of forming a filter for a smoking article in accordance with the present invention.

FIG. 5 illustrates a process for forming a plurality of filters for smoking articles in accordance with the present invention. In a substantially continuous rod 100 of filtration material additive delivery elements 20 are embedded such that consecutive additive delivery elements are spaced apart in the longitudinal direction of the rod 100 alternatively by a first distance D1 of about 36 millimetres and a second distance D2 of about 18 millimetres. The additive delivery elements 20 are surrounded on all sides by the filtration material.

The substantially continuous filter rod 100 at cut lines spaced longitudinally by a third distance D3, of about 27 millimetres to produce filter segments 12 of filtration material. Thus, each filter segment 12 includes an additive delivery element 20 embedded in the filter segment. The additive delivery element 20 is at about 18 mm (0.5 times D1) from one end of the filter segment 12 and at about 9 millimetres (0.5 times D2) from the opposite end of the filter segment. It shall be appreciated that the second distance C corresponds to 0.5 times D1 and the third distance E corresponds to 0.5 times D2.

The invention claimed is:

1. A smoking article comprising:

a tobacco rod;

a filter axially aligned in an abutting end-to-end relationship with the tobacco rod, the filter consisting of a single segment of filtration material having an overall length (L) and extending from a mouth end to a tobacco rod end;

a ventilation zone at a location along the filter segment at a first distance (V) from the mouth end of the filter;

an additive delivery element at a location along the filter segment upstream of the ventilation zone and at a second distance (C) from the mouth end of the filter, such that the ventilation zone is at least 5 millimetres apart from the additive delivery element;

wherein:

the overall length (L) of the filter is from 20 millimetres to 36 millimetres;

the first distance (V) between the ventilation zone and the mouth end of the filter is from 11 millimetres to 28 millimetres; and the second distance (C) between the additive delivery element and the mouth end of the filter is from 16 millimetres to 33 millimetres;

wherein a third distance (E) between the additive delivery element and the tobacco rod end of the filter is at least 3 millimetres and less than 10 millimetres.

2. A smoking article according to claim 1, wherein the overall length (L) of the filter is at least 25 millimetres.

3. A smoking article according to claim 1, wherein the difference between the second distance (C) and the first distance (V) is at least 18 millimetres.

4. A smoking article according to claim 1, wherein the ratio ((C−V)/L) between the difference between the second distance (C) and the first distance (V) and the overall length (L) is at least 0.45.

5. A filter for a smoking article, the filter being formed of a single segment of filtration material having an overall length (L) and extending from a first end to a second end;

the filter comprising a ventilation zone at a location along the filter segment between the first end and the second end;

an additive delivery element at a location along the filter segment between the ventilation zone and the second end, such that the additive delivery element is at least 5 millimetres apart from the ventilation zone; wherein:

the overall length (L) of the filter is from 20 millimetres to 36 millimetres;

a first distance between the ventilation zone and the first end of the filter is from 11 mm to 28 millimetres; and a second distance (C) between the additive delivery element and the first end of the filter is from 16 millimetres to 33 millimetres;

wherein a third distance (E) between the additive delivery element and the second end of the filter is at least 3 millimetres and less than 10 millimetres.

* * * * *